US008427253B2

(12) United States Patent
Satake et al.

(10) Patent No.: US 8,427,253 B2
(45) Date of Patent: Apr. 23, 2013

(54) NONRECIPROCAL DEVICE

(75) Inventors: Yoshiaki Satake, Kanagawa-ken (JP); Yuuichi Shiraishi, Kanagawa-ken (JP); Ryota Suzuki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 51 days.

(21) Appl. No.: 13/224,826

(22) Filed: Sep. 2, 2011

(65) Prior Publication Data

US 2012/0126910 A1 May 24, 2012

(30) Foreign Application Priority Data

Nov. 19, 2010 (JP) ..... P2010-259007

(51) Int. Cl.
*H01P 1/387* (2006.01)

(52) U.S. Cl.
USPC ..... 333/1.1; 333/24.2

(58) Field of Classification Search ..... 333/1.1, 333/24.2
See application file for complete search history.

(56) References Cited

U.S. PATENT DOCUMENTS

| | | | | |
|---|---|---|---|---|
| 7,495,521 | B2 * | 2/2009 | Chen et al. | 333/1.1 |
| 8,183,953 | B2 * | 5/2012 | Chawla et al. | 333/1.1 |
| 2009/0051456 | A1 | 2/2009 | Paquette et al. | |
| 2011/0193649 | A1 * | 8/2011 | Popelka et al. | 333/1.1 |

FOREIGN PATENT DOCUMENTS

| | | |
|---|---|---|
| JP | 63-240101 | 10/1988 |
| JP | 2001-230604 | 8/2001 |

OTHER PUBLICATIONS

Office Action (with English translation) issued on Nov. 13, 2012, in counterpart Japanese Appln No. 2010-259007 (4 pages).

* cited by examiner

*Primary Examiner* — Stephen Jones
(74) *Attorney, Agent, or Firm* — Oblon, Spivak, McClelland, Maier & Neustadt, L.L.P.

(57) ABSTRACT

According to one embodiment, a nonreciprocal device includes a first component portion serving a circulator and a second component portion serving a circulator. The first component portion includes: a first carrier; a first Y junction-shaped line including three branch lines; first, second and third lines respectively connected to the three branch lines of the first Y junction-shaped line; and fourth and fifth lines. The second component portion includes: a second carrier plate provided on a back surface of the first carrier plate; a second Y junction-shaped line including three branch lines; sixth, seventh and eighth lines respectively connected to the three branch lines of the second Y junction-shaped line, one of the sixth, seventh and eighth lines being connected to one of the first, second and third lines, the other two of the sixth, seventh and eighth lines being respectively connected to the fourth and fifth lines.

9 Claims, 11 Drawing Sheets

NONRECIPROCAL DEVICE

CROSS-REFERENCE TO RELATED APPLICATION(S)

This application is based upon and claims the benefit of priority from the prior Japanese Patent Application No. 2010-259007, filed on Nov. 19, 2010, the entire contents of which are incorporated herein by reference.

FIELD

The embodiments relate to a nonreciprocal device.

BACKGROUND

A three-port nonreciprocal device includes: a carrier plate; a ferrite substrate provided on this carrier plate; a Y junction-shaped line provided on the ferrite substrate; a spacer provided on this line; and a permanent magnet provided on this spacer.

In some cases, multiple three-port nonreciprocal devices are connected together for increasing the number of ports to four or more. For example, a conventional four-port nonreciprocal device includes two three-port nonreciprocal devices which are connected together in series on the same surface of a carrier plate (see the description of U.S. Pat. No. 7,772,937).

Because the volume of the permanent magnet used in each nonreciprocal device is large, the packaging area of the three-port nonreciprocal device is large. For this reason, a four-port circulator needs twice as large a part-packaging area as a three-port circulator does. This increases the area of a packaging substrate.

Against this background, there have been demands for a multi-port nonreciprocal device which does not entail the increase in the packaging area.

DETAILED DESCRIPTION

According to one embodiment, a nonreciprocal device includes a first component portion and a second component portion. The first component portion includes: a first carrier plate made of metal; a first ferrite substrate provided on a front surface of the first carrier plate; a first Y junction-shaped line provided on the first ferrite substrate, and including three branch lines; first, second and third lines provided on the first ferrite substrate, and respectively connected to the three branch lines of the first Y junction-shaped line; fourth and fifth lines provided on the first ferrite substrate; a first spacer provided on the first Y junction-shaped line, and made of an insulator; and a first permanent magnet provided on the first spacer. The second component portion includes: a second carrier plate provided on a back surface of the first carrier plate, and made of metal; a second ferrite substrate provided on the second carrier plate; a second Y junction-shaped line provided on the second ferrite substrate, and including three branch lines; sixth, seventh and eighth lines provided on the second ferrite substrate, and respectively connected to the three branch lines of the second Y junction-shaped line, one of the sixth, seventh and eighth lines being connected to one of the first, second and third lines, the other two of the sixth, seventh and eighth lines being respectively connected to the fourth and fifth lines; a second spacer provided on the second Y junction-shaped line, and made of an insulator; and a second permanent magnet provided on the second spacer.

Detailed descriptions will be hereinbelow provided for embodiments of a nonreciprocal device by use of the drawings.

First Embodiment

Figures 1A, 1B, 1C:
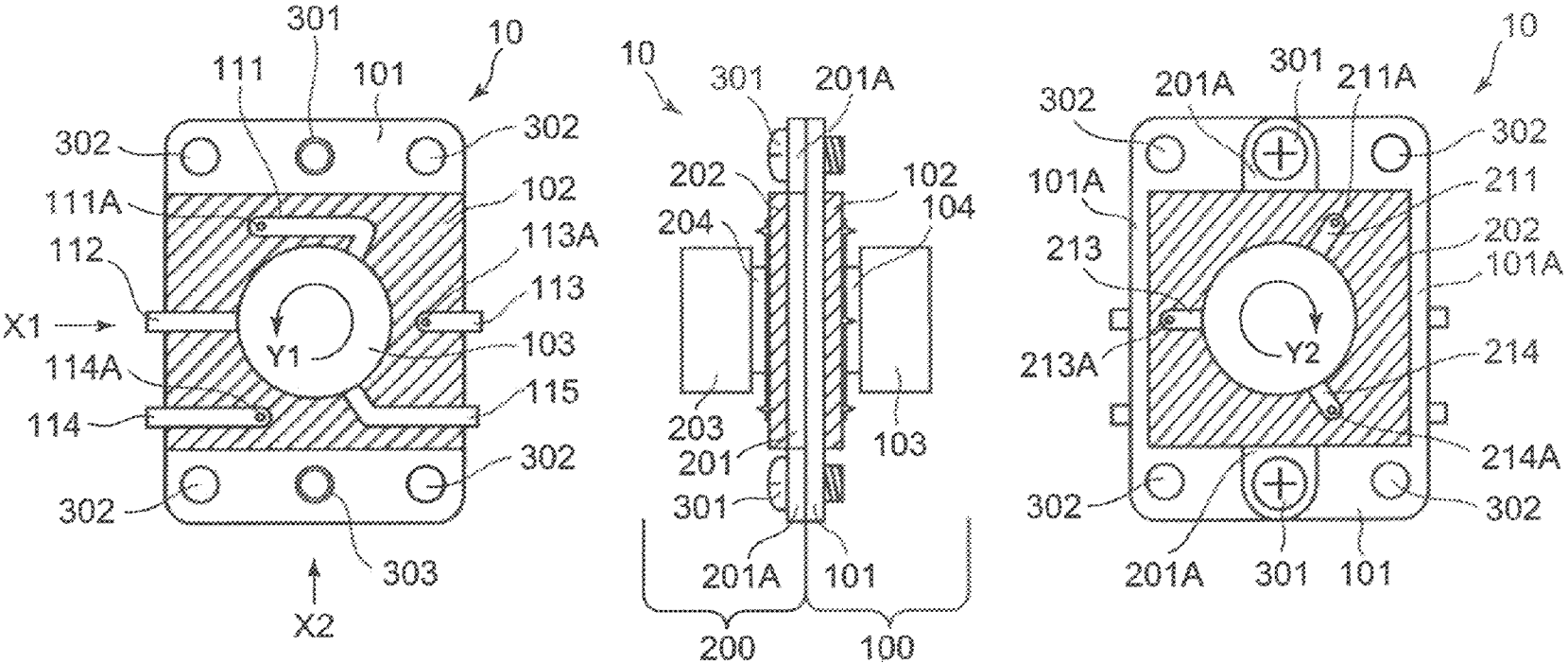
FIGS. 1A to 1E show a configuration of a nonreciprocal device of a first embodiment.
Figure 1D:
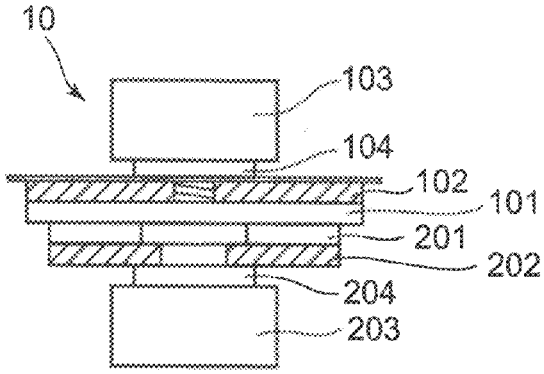
Figure 1E:
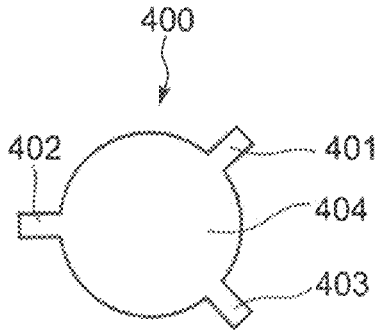

FIGS. 1A to 1E show a configuration of a nonreciprocal device 10 of a first embodiment. FIG. 1A is a plan view of the nonreciprocal device 10; FIG. 1B is a side view of the nonreciprocal device 10 viewed in a direction indicated by an arrow X1 in FIG. 1A; FIG. 1C is a bottom view of the nonreciprocal device 10; FIG. 1D is a front view of the nonreciprocal device 10 viewed in a direction indicated by an arrow X2 in FIG. 1A; and FIG. 1E is diagram showing a Y junction-shaped line 400 included in the nonreciprocal device 10.

As shown in FIG. 1B, the nonreciprocal device 10 includes a first component portion 100 and a second component portion 200.

The first component portion 100 includes: a first carrier plate 101 made of metal; a first ferrite substrate 102 provided on the front surface of the first carrier plate 101; a first Y junction-shaped line 400 provided on the first ferrite substrate 102; a first spacer 104 provided on the first Y junction-shaped line 400, and made of an insulator; and a first permanent magnet 103 provided on the first spacer 104.

The first component portion 100 further includes a first line 111, a second line 112, a third line 115, a fourth line 113 and a fifth line 114, which are all provided on the front surface of the first ferrite substrate 102. The first line 111 is connected to a first branch line 401 of the first Y junction-shaped line 400. The second line 112 is connected to a second branch line 402 of the first Y junction-shaped line 400. The third line 115 is connected to a third branch line 403 of the first Y junction-shaped line 400. The first carrier plate 101, the first ferrite substrate 102, the first spacer 104 and the first permanent magnet 103 are fixed to one another, for example, by use of an adhesive. The first component portion 100 constitutes a first circulator. The first line 111, the second line 112, the third line 115 and the first Y junction-shaped line 400 may be formed in one.

A second component portion 200 includes: a second carrier plate 201 provided on the back surface of the first carrier plate 101, and made of metal; a second ferrite substrate 202 provided on the second carrier plate 201; a second Y junction-shaped line 400 provided on the second ferrite substrate 202; a second spacer 204 provided on the second Y junction-shaped line 400, and made of an insulator; and a second permanent magnet 203 provided on the second spacer 204.

The second component portion 200 further includes a sixth line 211, a seventh line 213 and an eighth line 214, which are all provided on the second ferrite substrate 202. The sixth line 211 is connected to a first branch line 401 of the second Y junction-shaped line 400. The seventh line 213 is connected to a second branch line 402 of the second Y junction-shaped line 400. The eighth line 214 is connected to a third branch line 403 of the second Y junction-shaped line 400. The second carrier plate 201, the second ferrite substrate 202, the second spacer 204 and the second permanent magnet 203 are fixed to one another, for example, by use of an adhesive. The second component portion 200 constitutes a second circulator. The sixth line 211, the seventh line 213, the eighth line 214 and the second Y junction-shaped line 400 may be formed in one.

The first carrier plate 101 is rectangular, and through-holes 302 are opened in the respective four corners of the first carrier plate 101. Screw holes 303 are opened in the centers of the two short sides of the first carrier plate 101, respectively. The first ferrite substrate 102 has a width which is as long as the widthwise length of the first carrier plate 101, and has a length which is short enough not to cover the through-holes 302.

The second carrier plate 201 has a width which is shorter than the widthwise length of the first carrier plate 101. Accordingly, grounding portions 101A of the first carrier plate 101 are exposed to the outside in the two widthwise ends of the second carrier plate 201. The second carrier plate 201 has a length which is short enough not to cover the through-holes 302.

The second carrier plate 201 has locking portions 201A for assembling the second carrier plate 201 and the first carrier plate 101 together. Through-holes are opened in the respective locking portions 201A. The first carrier plate 101 and the second carrier plate 201 are assembled together by use of screws 301.

The second ferrite substrate 202 has a width which is as long as the widthwise length of the second carrier plate 201. The second ferrite substrate 202 has a length which is short enough not to cover the through-holes 302 or the locking portions 201A.

A surface of the first permanent magnet 103, which is bonded to the first spacer 104, is magnetized to an S pole in order that radio-frequency energy can rotate in a direction indicated by an arrow Y1. A surface of the second permanent magnet 203, which is bonded to the second spacer 204, is magnetized to an N pole in order that the radio-frequency energy can rotate in a direction indicated by an arrow Y2. In other words, the second permanent magnet 203 is magnetized in a direction which is opposite to a magnetization direction of the first permanent magnet 103.

Figures 3A, 3B, 3C:
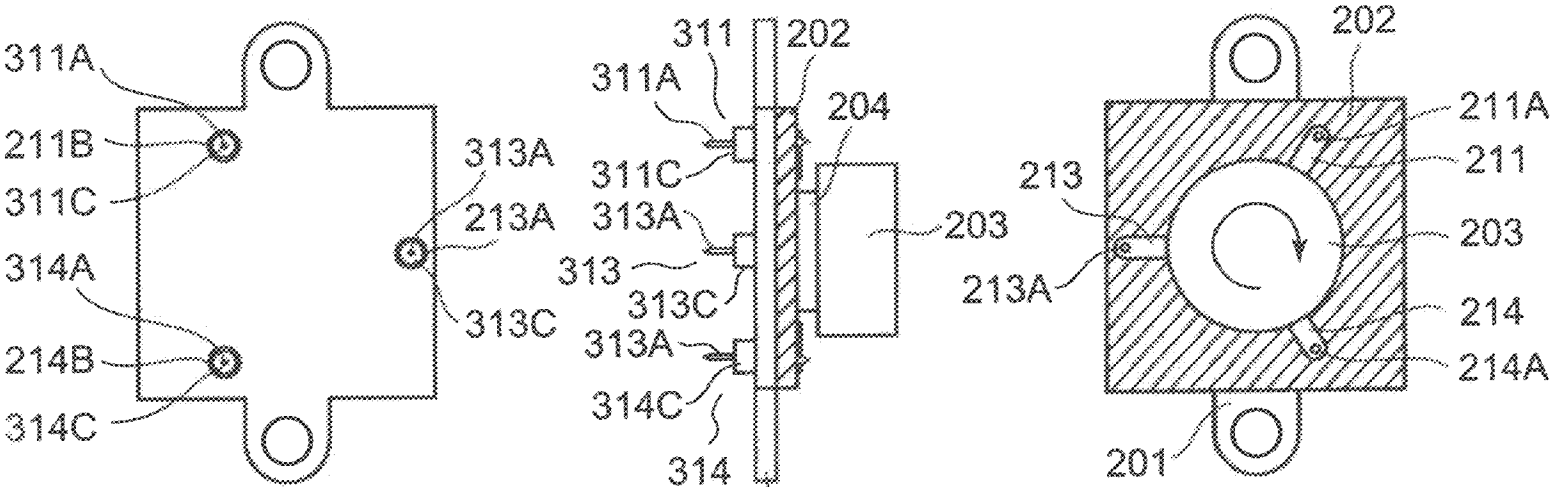
FIGS. 3A to 3C show a configuration of a second component portion included in the nonreciprocal device of the first embodiment.

The first line 111 and the sixth line 211 are connected together by connecting a connecting portion 111A and a connecting portion 211A together though a coaxial terminal 311 (see FIG. 3B).

The fourth line 113 and the seventh line 213 are connected together by connecting a connecting portion 113A and a connecting portion 213A together though a coaxial terminal 313 (see FIG. 3B).

The fifth line 114 and the eighth line 214 are connected together by connecting a connecting portion 114A and a connecting portion 214A together though a coaxial terminal 314 (see FIG. 3B).

In other words, the connection of the first line 111 and the sixth line 211, the connection of the fourth line 113 and the seventh line 213, as well as the connection of the fifth line 114 and the eighth line 214 are achieved by use of the respective conductors which penetrate the first ferrite substrate 102, the first carrier plate 101, the second carrier plate 201 and the second ferrite substrate 202.

The radio-frequency energy inputted into the second line 112 is outputted from the third line 115. The radio-frequency energy inputted into the third line 115 is outputted from the fifth line 114 via the first line 111, the sixth line 211 and the eighth line 214.

The radio-frequency energy inputted into the fourth line 113 is outputted from the second line 112 via the seventh line 213, the sixth line 211 and the first line 111.

The radio-frequency energy inputted into the fifth line 114 is outputted from the fourth line 113 via the eighth line 214 and the seventh line 213.

Figure 2A:
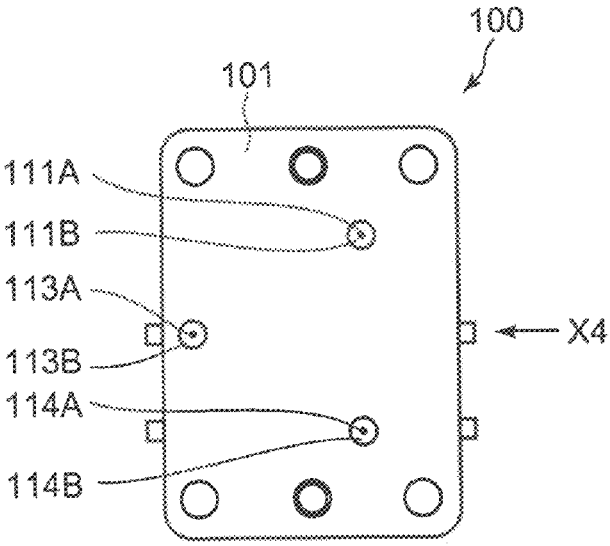
FIGS. 2A and 2B show a configuration of a first component portion included in the nonreciprocal device of the first embodiment.
Figure 2B:
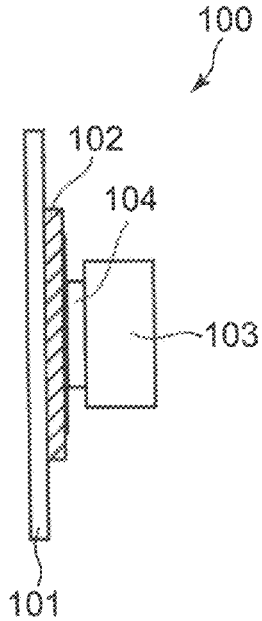

FIGS. 2A and 2B show a configuration of the first component portion 100. FIG. 2A is a bottom view of the first component portion 100, and FIG. 2B is a side view of the first component portion 100 viewed in a direction indicated by an arrow X4 in FIG. 2A. The plan view of the first component 100 looks the same as the plan view shown in FIG. 1A.

The first carrier plate 101 and the first ferrite substrate 102 include: a through-hole 111B leading to the connecting portion 111A; a through-hole 113B leading to the connecting portion 113A; and a through-hole 114B leading to the connecting portion 114A.

FIGS. 3A to 3C are diagrams showing a configuration of the second component portion 200. FIGS. 3A to 3C are a bottom view, side view, and plan view of the second component portion 200, respectively.

The second carrier plate 201 and the second ferrite substrate 202 include: a through-hole 211B leading to the connecting portion 211A; a through-hole 213B leading to the connecting portion 213A; and a through-hole 214B leading to the connecting portion 214A. A coaxial terminal 311 is provided in the through-hole 211B, and a core wire 311A of the coaxial terminal 311 is connected to the connecting portion 211A. The coaxial terminal 311 includes the core wire 311A and an insulating portion 311C. The core wire 311A, the insulating portion 311C, and portions of the first carrier plate 101 and the second carrier plate 201 around the insulating portion 311C constitute a coaxial line.

A coaxial terminal 313 is provided in the through-hole 213B, and a core wire 313A of the coaxial terminal 313 is connected to the connecting portion 213A. The coaxial terminal 313 includes the core wire 313A and an insulating portion 313C. The core wire 313A, the insulating portion 313C, and portions of the first carrier plate 101 and the second carrier plate 201 around the insulating portion 313C constitute a coaxial line.

A coaxial terminal 314 is provided in the through-hole 214B, and a core wire 314A of the coaxial terminal 314 is connected to the connecting portion 214A. The coaxial terminal 314 includes the core wire 314A and an insulating portion 314C. The core wire 314A, the insulating portion 314C, and portions of the first carrier plate 101 and the second carrier plate 201 around the insulating portion 314C constitute a coaxial line.

Figure 4:
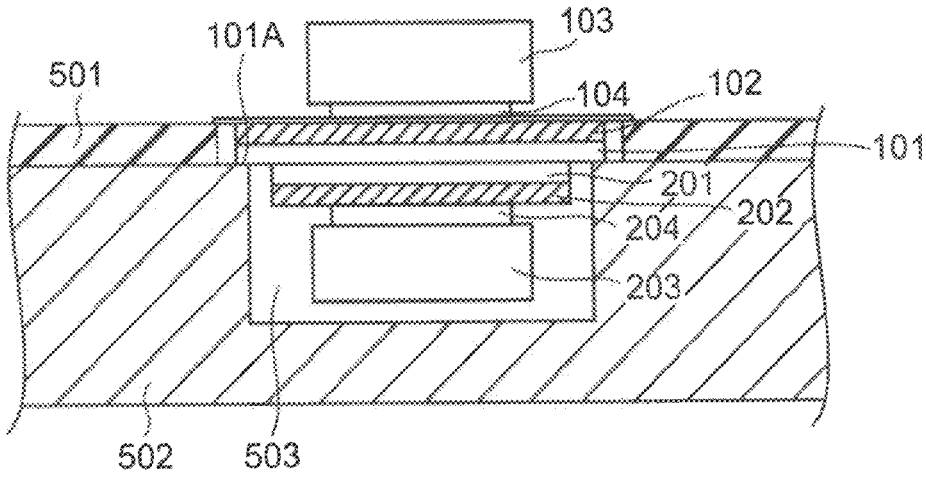
FIG. 4 is a cross-sectional view showing an example of how the nonreciprocal device of the first embodiment is used.

FIG. 4 is a cross-sectional view showing an example of how the nonreciprocal device 10 is used. A base plate 502 is made of metal, and includes a groove portion 503. A dielectric layer 501 is placed on the base plate 502, and has an opening which is capable of accepting the first carrier plate 101. The dielectric layer 501 has wirings (not illustrated), which are connected to the lines 112, 113, 114, 115 of the nonreciprocal device 10, in its front surface. The second component portion 200 of the nonreciprocal device 10 is accommodated in the groove portion 503 of the base plate 502 in a way that the grounding portions 101A of the first carrier plate 101 are in contact with the front surface of the base plate 502. The nonreciprocal device 10 is fixed to the base plate 502 by use of screws (not illustrated). Thereby, the nonreciprocal device 10 is grounded to the base plate 502.

In the nonreciprocal device 10 of the first embodiment, as described above, the first carrier plate 101 of the first component portion 100 serving as the first circulator and the second carrier plate 201 of the second component portion 200 serving as the second circulator are assembled together in a way that the back surface of the first carrier plate 101 and the back surface of the second carrier plate 201 face each other; one branch line of the second Y junction-shaped line 400 of the second circulator is connected to one branch line of the first Y junction-shaped line 400 of the first circulator; and the other two branch lines of the second Y junction-shaped line 400 are respectively connected to two lines on the first ferrite substrate 102 of the first circulator.

For this reason, the nonreciprocal device 10 of the first embodiment has an effect that its packaging area does not increase. In addition, because the magnetization direction of the first permanent magnet 103 and the magnetization direction of the second permanent magnet 203 are opposite to each other, the first permanent magnet 103 and the second permanent magnet 203 attract each other, and the lines of magnetic force are accordingly not disturbed. As a result, the nonreciprocal device 10 of the first embodiment offers an effect that the performance of the nonreciprocal device 10 is better than the performance of a nonreciprocal device obtained by connecting together two circulators which are arranged in the lateral direction.

Second Embodiment

Figure 5C:
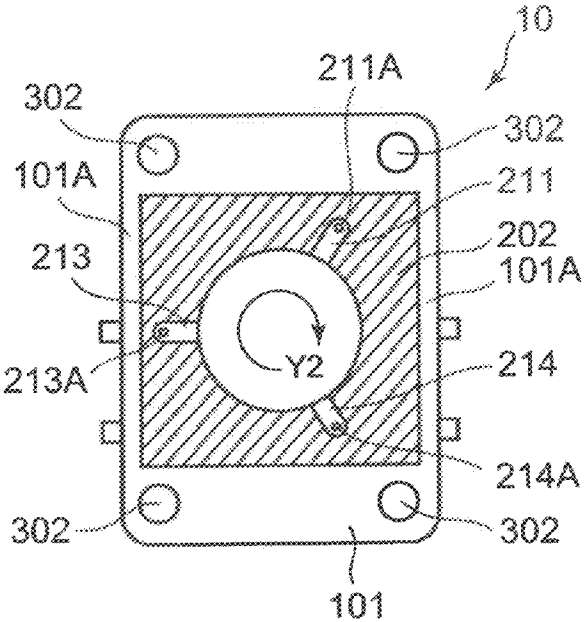
FIGS. 5A to 5E show a configuration of a nonreciprocal device of a second embodiment.
Figure 5B:
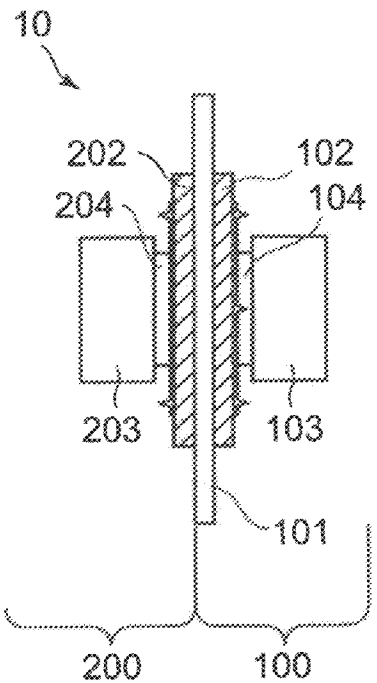
Figure 5A:
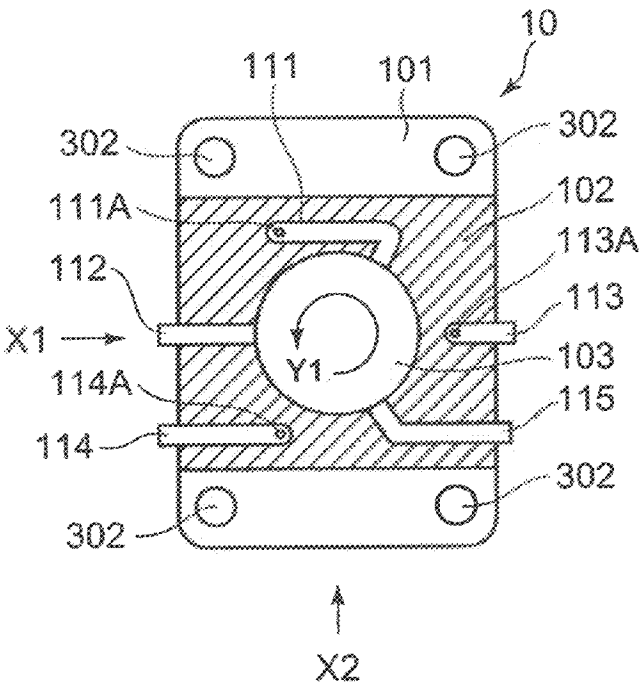
Figure 5D:
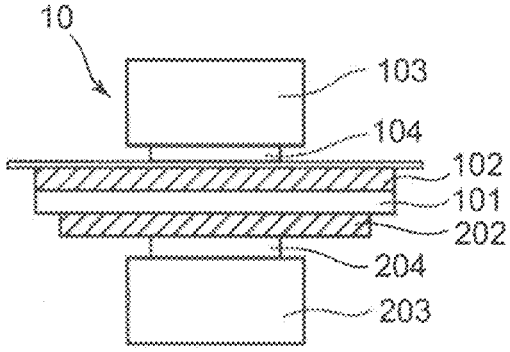
Figure 5E:
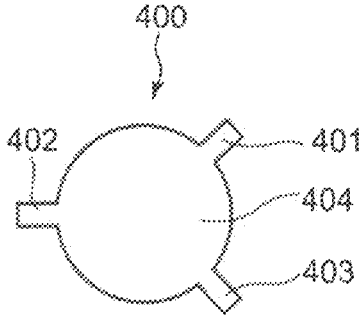

FIGS. 5A to 5E show a configuration of a nonreciprocal device 10 of a second embodiment. FIG. 5A is a plan view of the nonreciprocal device 10; FIG. 5B is a side view of the nonreciprocal device 10 viewed in a direction indicated by an arrow X1 in FIG. 5A; FIG. 5C is a bottom view of the nonreciprocal device 10; FIG. 5D is a front view of the nonreciprocal device 10 viewed in a direction indicated by an arrow X2 in FIG. 5A; and FIG. 5E is diagram showing a Y junction-shaped line 400 included in the nonreciprocal device 10.

As shown in FIG. 5B, the nonreciprocal device 10 includes a first component portion 100 and a second component portion 200.

The first component portion 100 includes: a first carrier plate 101 made of metal; a first ferrite substrate 102 provided on the front surface of the first carrier plate 101; a first Y junction-shaped line 400 provided on the first ferrite substrate 102; a first spacer 104 provided on the first Y junction-shaped line 400, and made of an insulator; and a first permanent magnet 103 provided on the first spacer 104.

The first component portion 100 further includes a first line 111, a second line 112, a third line 115, a fourth line 113 and a fifth line 114, which are all provided on the front surface of the first ferrite substrate 102. The first line 111 is connected to a first branch line 401 of the first Y junction-shaped line 400. The second line 112 is connected to a second branch line 402 of the first Y junction-shaped line 400. The third line 115 is connected to a third branch line 403 of the first Y junction-shaped line 400. The first carrier plate 101, the first ferrite substrate 102, the first spacer 104 and the first permanent magnet 103 are fixed to one another, for example, by use of an adhesive. The first component portion 100 constitutes a first circulator.

A second component portion 200 includes: a second ferrite substrate 202 provided on the back surface of the first carrier plate 101; a second Y junction-shaped line 400 provided on the second ferrite substrate 202; a second spacer 204 provided on the second Y junction-shaped line 400, and made of an insulator; and a second permanent magnet 203 provided on the second spacer 204.

The second component portion 200 further includes a sixth line 211, a seventh line 213 and an eighth line 214, which are all provided on the second ferrite substrate 202. The sixth line 211 is connected to a first branch line 401 of the second Y junction-shaped line 400. The seventh line 213 is connected to a second branch line 402 of the second Y junction-shaped line 400. The eighth line 214 is connected to a third branch line 403 of the second Y junction-shaped line 400. The first carrier plate 101, the second ferrite substrate 202, the second spacer 204 and the second permanent magnet 203 are fixed to one another, for example, by use of an adhesive. The second component portion 200 constitutes a second circulator.

The first carrier plate 101 is rectangular, and through-holes 302 are opened in the respective four corners of the first carrier plate 101. The first ferrite substrate 102 has a width which is as long as the widthwise length of the first carrier plate 101, and has a length which is short enough not to cover the through-holes 302.

The second carrier plate 201 has a width which is shorter than the widthwise length of the first carrier plate 101. Accordingly, grounding portions 101A of the first carrier plate 101 are exposed to the outside in the two widthwise ends of the second carrier plate 201. The second ferrite substrate 202 has a length which is short enough not to cover the through-holes 302.

A surface of the first permanent magnet 103, which is bonded to the first spacer 104, is magnetized to an S pole in order that radio-frequency energy can rotate in a direction indicated by an arrow Y1. A surface of the second permanent magnet 203, which is bonded to the second spacer 204, is magnetized to an N pole in order that the radio-frequency energy can rotate in a direction indicated by an arrow Y2. In other words, the second permanent magnet 203 is magnetized in a direction which is opposite to a magnetization direction of the first permanent magnet 103.

The first line 111 and the sixth line 211 are connected together by connecting a connecting portion 111A and a connecting portion 211A together though a coaxial terminal 311.

The fourth line 113 and the seventh line 213 are connected together by connecting a connecting portion 113A and a connecting portion 213A together though a coaxial terminal 313.

The fifth line 114 and the eighth line 214 are connected together by connecting a connecting portion 114A and a connecting portion 214A together though a coaxial terminal 314.

In other words, the connection of the first line 111 and the sixth line 211, the connection of the fourth line 113 and the seventh line 213, as well as the connection of the fifth line 114 and the eighth line 214 are achieved by use of the respective conductors which penetrate the first ferrite substrate 102, the first carrier plate 101 and the second ferrite substrate 202.

The radio-frequency energy inputted into the second line 112 is outputted from the third line 115. The radio-frequency energy inputted into the third line 115 is outputted from the fifth line 114 via the first line 111, the sixth line 211 and the eighth line 214.

The radio-frequency energy inputted into the fourth line 113 is outputted from the second line 112 via the seventh line 213, the sixth line 211 and the first line 111.

The radio-frequency energy inputted into the fifth line 114 is outputted from the fourth line 113 via the eighth line 214 and the seventh line 213.

A structure of the first component portion 100 is the same as the structure of the first component portion 100 of the first embodiment. In other words, in the first component portion 100 of the nonreciprocal device, the first carrier plate 101 and the first ferrite substrate 102 include: a through-hole 111B leading to the connecting portion 111A; a through-hole 113B leading to the connecting portion 113A; and a through-hole 114B leading to the connecting portion 114A.

Figure 6C:
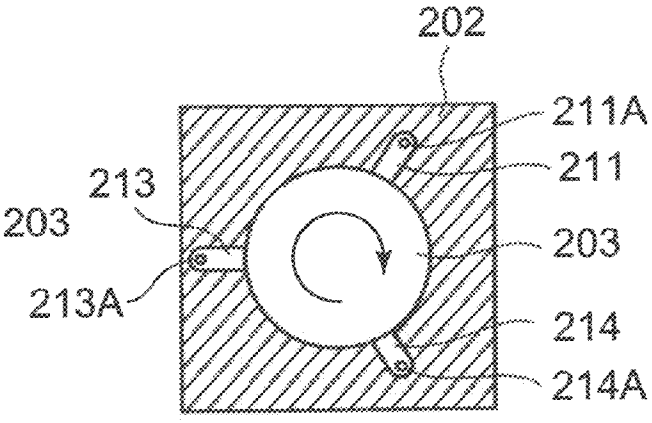
FIGS. 6A to 6C show a configuration of a second component portion included in the nonreciprocal device of the second embodiment.
Figure 6B:
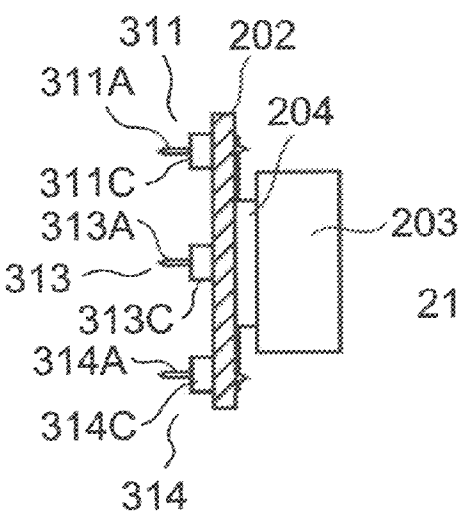
Figure 6A:
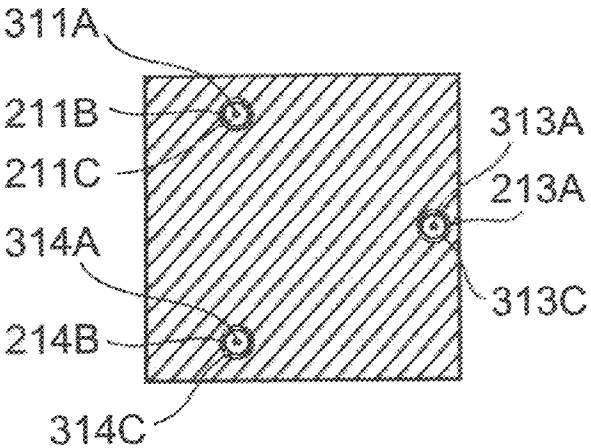

FIGS. 6A to 6C are diagrams showing a configuration of the second component portion 200. FIGS. 6A to 6C are a bottom view, side view, and plan view of the second component portion 200, respectively.

In the component portion 200, the second ferrite substrate 202 include: a through-hole 211B leading to the connecting portion 211A; a through-hole 213B leading to the connecting portion 213A; and a through-hole 214B leading to the connecting portion 214A. A coaxial terminal 311 is provided in the through-hole 211B, and a core wire 311A of the coaxial terminal 311 is connected to the connecting portion 211A. The coaxial terminal 311 includes the core wire 311A and an insulating portion 311C. The core wire 311A, the insulating portion 311C, and portions of the first carrier plate 101 around the insulating portion 311C constitute a coaxial line.

A coaxial terminal 313 is provided in the through-hole 213B, and a core wire 313A of the coaxial terminal 313 is connected to the connecting portion 213A. The coaxial terminal 313 includes the core wire 313A and an insulating portion 313C. The core wire 313A, the insulating portion 313C, and portions of the first carrier plate 101 around the insulating portion 313C constitute a coaxial line.

A coaxial terminal 314 is provided in the through-hole 214B, and a core wire 314A of the coaxial terminal 314 is connected to the connecting portion 214A. The coaxial terminal 314 includes the core wire 314A and an insulating portion 314C. The core wire 314A, the insulating portion 314C, and portions of the first carrier plate 101 around the insulating portion 314C constitute a coaxial line.

Figure 7:
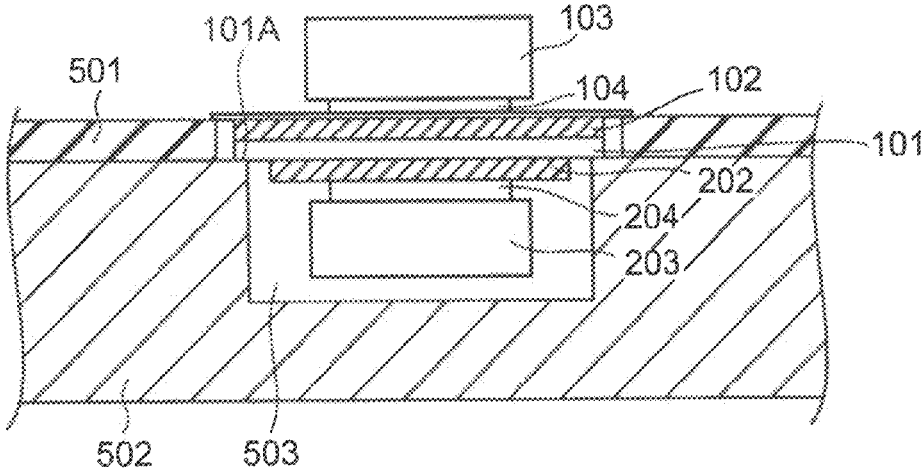
FIG. 7 is a cross-sectional view showing an example of how the nonreciprocal device of the second embodiment is used.

FIG. 7 is a cross-sectional view showing an example of how the nonreciprocal device 10 is used. A base plate 502 is made of metal, and includes a groove portion 503. A dielectric layer 501 is placed on the base plate 502, and has an opening which is capable of accepting the first carrier plate 101. The dielectric layer 501 has wirings (not illustrated), which are connected to the lines 112, 113, 114, 115 of the nonreciprocal device 10, in its front surface. The second component portion 200 of the nonreciprocal device 10 is accommodated in the groove portion 503 of the base plate 502 in a way that the grounding portions 101A of the first carrier plate 101 are in contact with the front surface of the base plate 502. The nonreciprocal device 10 is fixed to the base plate 502 by use of screws (not illustrated). Thereby, the nonreciprocal device 10 is grounded to the base plate 502.

In the nonreciprocal device 10 of the second embodiment, as described above, the first carrier plate 101 of the first component portion 100 serving as the first circulator and the second ferrite substrate 202 of the second component portion 200 serving as the second circulator are assembled together in a way that the back surface of the first carrier plate 101 and the back surface of the second ferrite substrate 202 face each other; one branch line of the second Y junction-shaped line 400 of the second circulator is connected to one branch line of the first Y junction-shaped line 400 of the first circulator; and the other two branch lines of the second Y junction-shaped line 400 are respectively connected to two lines on the first ferrite substrate 102 of the first circulator.

For this reason, the nonreciprocal device 10 of the second embodiment has an effect that its packaging area does not increase. In addition, because the nonreciprocal device 10 of the second embodiment does not include a second carrier plate 201, the nonreciprocal device 10 of the second embodiment has an effect that the depth of the groove portion 403 of the bas plate 502 can be shallow compared with the nonreciprocal device 10 of the first embodiment.

Third Embodiment

Figure 8C:
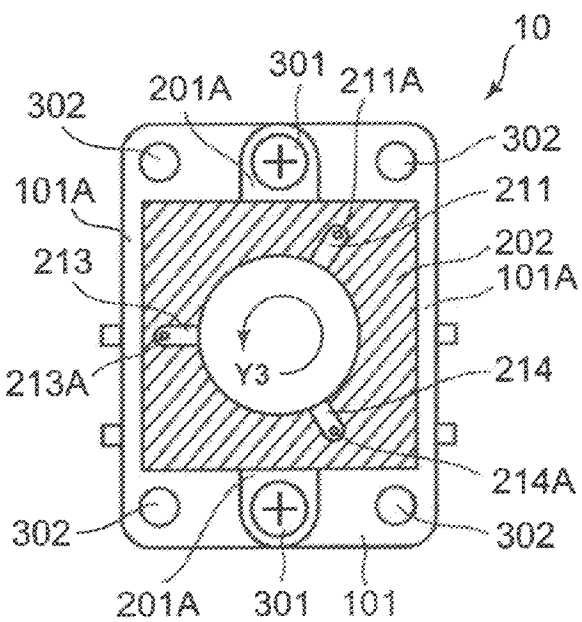
FIGS. 8A to 8E show a configuration of a nonreciprocal device of a third embodiment
Figure 8B:
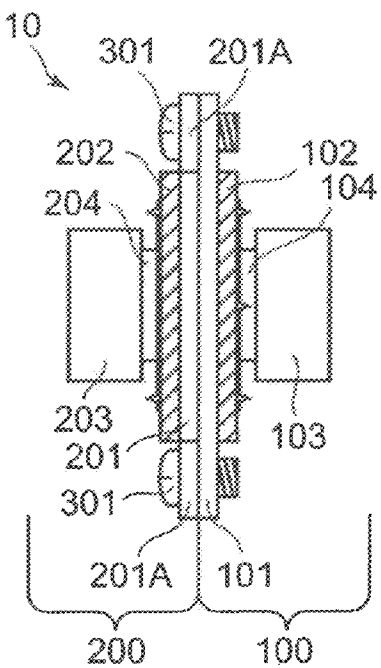
Figure 8A:
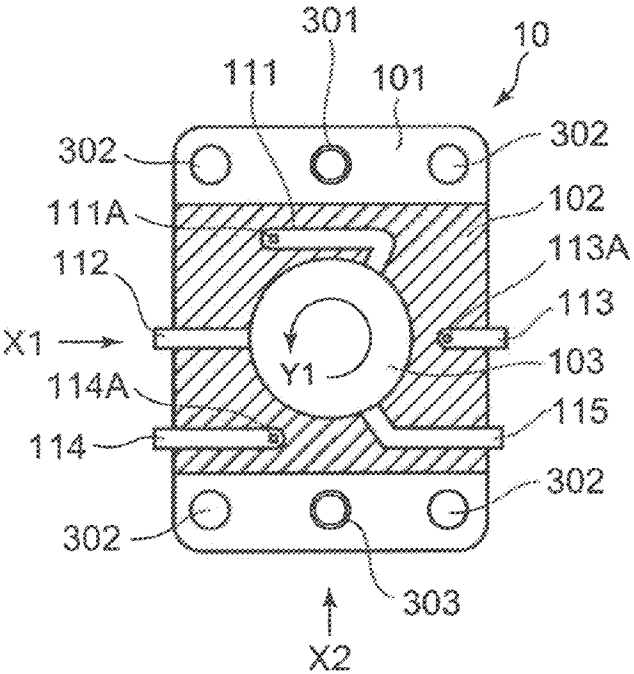
Figure 8D:
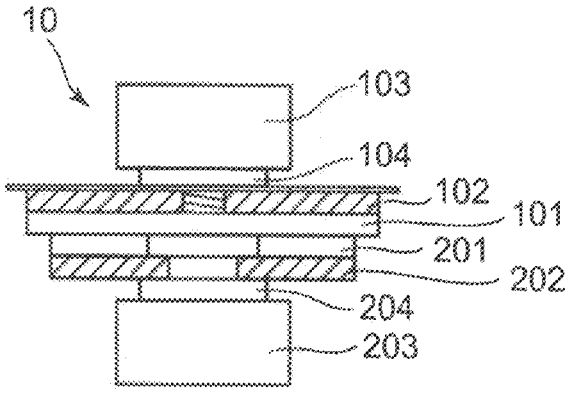
Figure 8E:
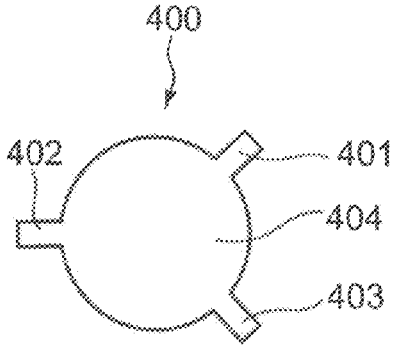

FIGS. 8A to 8E show a configuration of a nonreciprocal device 10 of a third embodiment. FIG. 8A is a plan view of the nonreciprocal device 10; FIG. 8B is a side view of the nonreciprocal device 10 viewed in a direction indicated by an arrow X1 in FIG. 8A; FIG. 8C is a bottom view of the nonreciprocal device 10; FIG. 8D is a front view of the nonreciprocal device 10 viewed in a direction indicated by an arrow X2 in FIG. 8A; and FIG. 8E is diagram showing a Y junction-shaped line 400 included in the nonreciprocal device 10.

As shown in FIG. 8B, the nonreciprocal device 10 includes a first component portion 100 and a second component portion 200.

The first component portion 100 includes: a first carrier plate 101 made of metal; a first ferrite substrate 102 provided on the front surface of the first carrier plate 101; a first Y junction-shaped line 400 provided on the first ferrite substrate 102; a first spacer 104 provided on the first Y junction-shaped line 400, and made of an insulator; and a first permanent magnet 103 provided on the first spacer 104.

The first component portion 100 further includes a first line 111, a second line 112, a third line 115, a fourth line 113 and a fifth line 114, which are all provided on the front surface of the first ferrite substrate 102. The first line 111 is connected to a first branch line 401 of the first Y junction-shaped line 400. The second line 112 is connected to a second branch line 402 of the first Y junction-shaped line 400. The third line 115 is connected to a third branch line 403 of the first Y junction-shaped line 400. The first carrier plate 101, the first ferrite substrate 102, the first spacer 104 and the first permanent magnet 103 are fixed to one another, for example, by use of an adhesive. The first component portion 100 constitutes a first circulator.

A second component portion 200 includes: a second carrier plate 201 provided on the back surface of the first carrier plate 101, and made of metal; a second ferrite substrate 202 provided on the second carrier plate 201; a second Y junction-shaped line 400 provided on the second ferrite substrate 202; a second spacer 204 provided on the second Y junction-shaped line 400, and made of an insulator; and a second permanent magnet 203 provided on the second spacer 204.

The second component portion 200 further includes a sixth line 211, a seventh line 213 and an eighth line 214, which are all provided on the second ferrite substrate 202. The sixth line 211 is connected to a first branch line 401 of the second Y junction-shaped line 400. The seventh line 213 is connected to a second branch line 402 of the second Y junction-shaped line 400. The eighth line 214 is connected to a third branch line 403 of the second Y junction-shaped line 400. The second carrier plate 201, the second ferrite substrate 202, the second spacer 204 and the second permanent magnet 203 are fixed to one another, for example, by use of an adhesive. The second component portion 200 constitutes a second circulator.

The first carrier plate 101 is rectangular, and through-holes 302 are opened in the respective four corners of the first carrier plate 101. Screw holes 303 are opened in the centers of the two short sides of the first carrier plate 101, respectively. The first ferrite substrate 102 has a width which is as long as the widthwise length of the first carrier plate 101, and has a length which is short enough not to cover the through-holes 302.

The second carrier plate 201 has a width which is shorter than the widthwise length of the first carrier plate 101. Accordingly, grounding portions 101A of the first carrier plate 101 are exposed to the outside in the two widthwise ends of the second carrier plate 201. The second ferrite substrate 202 has a length which is short enough not to cover the through-holes 302.

The second carrier plate 201 has locking portions 201A for assembling the second carrier plate 201 and the first carrier plate 101 together. Through-holes are opened in the respective locking portions 201A. The first carrier plate 101 and the second carrier plate 201 are assembled together by use of screws 301.

The second ferrite substrate 202 has a width which is as long as the widthwise length of the second carrier plate 201. The second ferrite substrate 202 has a length which is short enough not to cover the through-holes 302 or the locking portions 201A.

A surface of the first permanent magnet 103, which is bonded to the first spacer 104, is magnetized to an S pole in order that radio-frequency energy can rotate in a direction indicated by an arrow Y1. A surface of the second permanent magnet 203, which is bonded to the second spacer 204, is magnetized to an S pole in order that the radio-frequency energy can rotate in a direction indicated by an arrow Y3. In other words, the second permanent magnet 203 is magnetized in the same direction as a magnetization direction of the first permanent magnet 103.

The first line 111 and the sixth line 211 are connected together by connecting a connecting portion 111A and a connecting portion 211A together though a coaxial terminal (not illustrated).

The fourth line 113 and the seventh line 213 are connected together by connecting a connecting portion 113A and a connecting portion 213A together though a coaxial terminal (not illustrated).

The fifth line 114 and the eighth line 214 are connected together by connecting a connecting portion 114A and a connecting portion 214A together though a coaxial terminal (not illustrated).

In other words, the connection of the first line 111 and the sixth line 211, the connection of the fourth line 113 and the seventh line 213, as well as the connection of the fifth line 114 and the eighth line 214 are achieved by use of the respective conductors which penetrate the first ferrite substrate 102, the first carrier plate 101, the second carrier plate 201 and the second ferrite substrate 202.

The radio-frequency energy inputted into the second line 112 is outputted from the third line 115. The radio-frequency energy inputted into the third line 115 is outputted from the fourth line 113 via the first line 111, the sixth line 211 and the seventh line 213.

The radio-frequency energy inputted into the fourth line 113 is outputted from the fifth line 114 via the seventh line 213 and the eighth line 214.

The radio-frequency energy inputted into the fifth line 114 is outputted from the second line 112 via the eighth line 214, the sixth line 211 and the first line 111.

In the nonreciprocal device 10 of the third embodiment, as described above, the first carrier plate 101 of the first component portion 100 serving as the first circulator and the second carrier plate 201 of the second component portion 200 serving as the second circulator are assembled together in a way that the back surface of the first carrier plate 101 and the back surface of the second carrier plate 201 face each other; one branch line of the second Y junction-shaped line 400 of the second circulator is connected to one branch line of the first Y junction-shaped line 400 of the first circulator; and the other two branch lines of the second Y junction-shaped line 400 are respectively connected to two lines on the first ferrite substrate 102 of the first circulator; the magnetization direction of the first permanent magnet 103 and the magnetization direction of the second permanent magnet 203 are the same.

For this reason, the nonreciprocal device 10 of the third embodiment has an effect that its packaging area does not increase. In addition, because the magnetization direction of the second permanent magnet 203 of the nonreciprocal device 10 of the third embodiment is opposite to the magnetization direction of the second permanent magnet 203 of the nonreciprocal device 10 of the first embodiment, the nonreciprocal device 10 of the third embodiment has an effect that an input-output path of the radio-frequency energy is changed.

Forth Embodiment

Figure 9C:
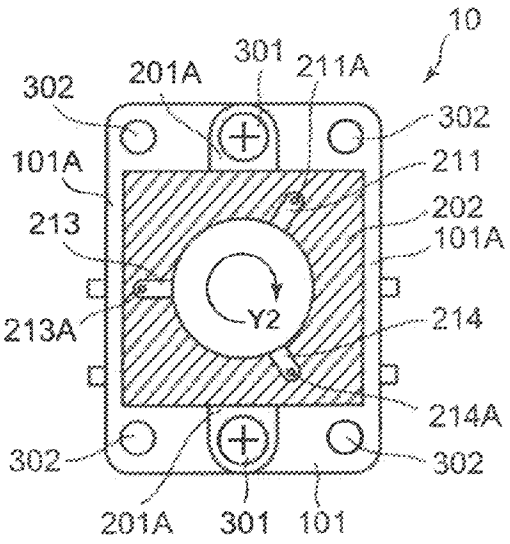
FIGS. 9A to 9E show a configuration of a nonreciprocal device of a fourth embodiment.
Figure 9B:
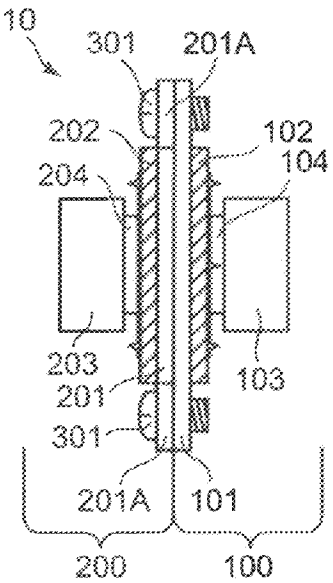
Figure 9A:
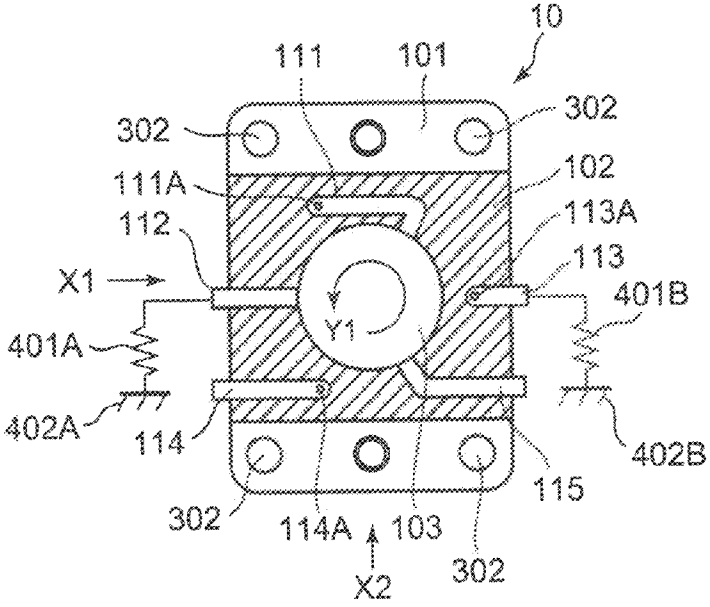
Figure 9D:
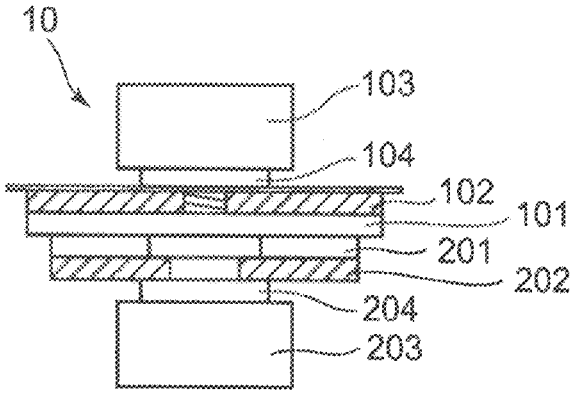
Figure 9E:
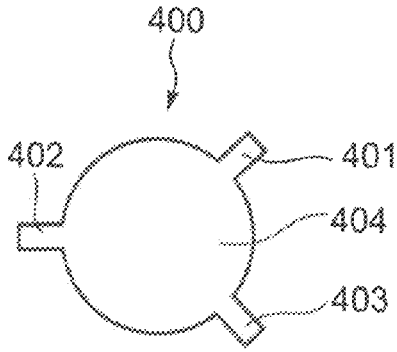

FIGS. 9A to 9E show a configuration of a nonreciprocal device 10 of a fourth embodiment. FIG. 9A is a plan view of the nonreciprocal device 10; FIG. 9B is a side view of the nonreciprocal device 10 viewed in a direction indicated by an arrow X1 in FIG. 9A; FIG. 9C is a bottom view of the nonreciprocal device 10; FIG. 9D is a front view of the nonreciprocal device 10 viewed in a direction indicated by an arrow X2 in FIG. 9A; and FIG. 9E is diagram showing a Y junction-shaped line 400 included in the nonreciprocal device 10.

As shown in FIG. 9B, the nonreciprocal device 10 includes a first component portion 100 and a second component portion 200.

The first component portion 100 includes: a first carrier plate 101 made of metal; a first ferrite substrate 102 provided on the front surface of the first carrier plate 101; a first Y junction-shaped line 400 provided on the first ferrite substrate 102; a first spacer 104 provided on the first Y junction-shaped line 400, and made of an insulator; and a first permanent magnet 103 provided on the first spacer 104.

The first component portion 100 further includes a first line 111, a second line 112, a third line 115, a fourth line 113 and a fifth line 114, which are all provided on the front surface of the first ferrite substrate 102. The first line 111 is connected to a first branch line 401 of the first Y junction-shaped line 400. The second line 112 is connected to a second branch line 402 of the first Y junction-shaped line 400. The third line 115 is connected to a third branch line 403 of the first Y junction-shaped line 400. The first carrier plate 101, the first ferrite substrate 102, the first spacer 104 and the first permanent magnet 103 are fixed to one another, for example, by use of an adhesive. The first component portion 100 constitutes a first circulator.

The first component portion 100 further includes a first termination circuit connected to the second line 112 and a second termination circuit connected to the fourth line 113. The first termination circuit includes a termination resistor 401A of which one end is connected to a ground 402A, for example. The second termination circuit includes a termination resistor 402B of which one end is connected to a ground 402B, for example. The first component portion 100 constitutes a first circulator.

A second component portion 200 includes: a second carrier plate 201 provided on the back surface of the first carrier plate 101, and made of metal; a second ferrite substrate 202 provided on the second carrier plate 201; a second Y junction-shaped line 400 provided on the second ferrite substrate 202; a second spacer 204 provided on the second Y junction-shaped line 400, and made of an insulator; and a second permanent magnet 203 provided on the second spacer 204.

The second component portion 200 further includes a sixth line 211, a seventh line 213 and an eighth line 214, which are all provided on the second ferrite substrate 202. The sixth line 211 is connected to a first branch line 401 of the second Y junction-shaped line 400. The seventh line 213 is connected to a second branch line 402 of the second Y junction-shaped line 400. The eighth line 214 is connected to a third branch line 403 of the second Y junction-shaped line 400. The second carrier plate 201, the second ferrite substrate 202, the second spacer 204 and the second permanent magnet 203 are fixed to one another, for example, by use of an adhesive. The second component portion 200 constitutes a second circulator.

The first carrier plate 101 is rectangular, and through-holes 302 are opened in the respective four corners of the first carrier plate 101. Screw holes 303 are opened in the centers of the two short sides of the first carrier plate 101, respectively. The first ferrite substrate 102 has a width which is as long as the widthwise length of the first carrier plate 101, and has a length which is short enough not to cover the through-holes 302.

The second carrier plate 201 has a width which is shorter than the widthwise length of the first carrier plate 101. Accordingly, grounding portions 101A of the first carrier plate 101 are exposed to the outside in the two widthwise ends of the second carrier plate 201. The second carrier plate 201 has a length which is short enough not to cover the through-holes 302.

The second carrier plate 201 has locking portions 201A for assembling the second carrier plate 201 and the first carrier plate 101 together. Through-holes are opened in the respective locking portions 201A. The first carrier plate 101 and the second carrier plate 201 are assembled together by use of screws 301.

The second ferrite substrate 202 has a width which is as long as the widthwise length of the second carrier plate 201. The second ferrite substrate 202 has a length which is short enough not to cover the through-holes 302 or the locking portions 201A.

A surface of the first permanent magnet 103, which is bonded to the first spacer 104, is magnetized to an S pole in order that radio-frequency energy can rotate in a direction indicated by an arrow Y1. A surface of the second permanent magnet 203, which is bonded to the second spacer 204, is magnetized to an N pole in order that the radio-frequency energy can rotate in a direction indicated by an arrow Y2. In other words, the second permanent magnet 203 is magnetized in a direction which is opposite to a magnetization direction of the first permanent magnet 103.

The first line 111 and the sixth line 211 are connected together by connecting a connecting portion 111A and a connecting portion 211A together though a coaxial terminal (not illustrated).

The fourth line 113 and the seventh line 213 are connected together by connecting a connecting portion 113A and a connecting portion 213A together though a coaxial terminal (not illustrated).

The fifth line 114 and the eighth line 214 are connected together by connecting a connecting portion 114A and a connecting portion 214A together though a coaxial terminal (not illustrated).

In other words, the connection of the first line 111 and the sixth line 211, the connection of the fourth line 113 and the seventh line 213, as well as the connection of the fifth line 114 and the eighth line 214 are achieved by use of the respective conductors which penetrate the first ferrite substrate 102, the first carrier plate 101, the second carrier plate 201 and the second ferrite substrate 202.

The radio-frequency energy inputted into the second line 112 is outputted from the third line 115. The radio-frequency energy inputted into the third line 115 is outputted from the fifth line 114 via the first line 111, the sixth line 211 and the eighth line 214.

The radio-frequency energy inputted into the fourth line 113 is outputted from the second line 112 via the seventh line 213, the sixth line 211 and the first line 111, and then converted into heat by the termination resistor 401A.

The radio-frequency energy inputted into the fifth line 114 is outputted from the fourth line 113 via the eighth line 214 and the seventh line 213, and then converted into heat by the termination resistor 401B.

In addition, a nonreciprocal device which has a 2-port isolator and a 3-port circulator can be constituted by omitting the first termination circuit or the second termination circuit. The nonreciprocal device to which the first termination circuit or the second termination circuit is connected is not limited to the nonreciprocal device of the first embodiment. The first termination circuit or the second termination circuit may be connected to the nonreciprocal device of the second embodiment or the nonreciprocal device of the third embodiment.

In the nonreciprocal device 10 of the fourth embodiment, as described above, the first carrier plate 101 of the first component portion 100 serving as the first isolator and the second carrier plate 201 of the second component portion 200 serving as the second isolator are assembled together in a way that the back surface of the first carrier plate 101 and the back surface of the second carrier plate 201 face each other; one branch line of the second Y junction-shaped line 400 of the second isolator is connected to one branch line of the first Y junction-shaped line 400 of the first isolator; and the other two branch lines of the second Y junction-shaped line 400 are respectively connected to two lines on the first ferrite substrate 102 of the first isolator.

For this reason, the nonreciprocal device 10 of the fourth embodiment has an effect that its packaging area does not increase. In addition, the non-reciprocal device of the fourth embodiment has an effect that it can provide a 2-port isolator or a non-reciprocal device having a 2-port isolator and a 3-port circulator without increasing in an area to mount.

According to at least one nonreciprocal device 10 mentioned above, the reciprocal device 10 which does not cause the increase in an area to mount is obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A nonreciprocal device comprising:

a first carrier plate made of metal;

a first ferrite substrate provided on a front surface of the first carrier plate;

a first Y junction-shaped line provided on the first ferrite substrate, and including three branch lines;

first, second and third lines provided on the first ferrite substrate, and respectively connected to the three branch lines of the first Y junction-shaped line;

fourth and fifth lines provided on the first ferrite substrate;

a first spacer provided on the first Y junction-shaped line, and made of an insulator;

a first permanent magnet provided on the first spacer;

a second carrier plate provided on a back surface of the first carrier plate, and made of metal;

a second ferrite substrate provided on the second carrier plate;

a second Y junction-shaped line provided on the second ferrite substrate, and including three branch lines;

sixth, seventh and eighth lines provided on the second ferrite substrate, and respectively connected to the three branch lines of the second Y junction-shaped line, one of the sixth, seventh and eighth lines being connected to one of the first, second and third lines, the other two of the sixth, seventh and eighth lines being respectively connected to the fourth and fifth lines;

a second spacer provided on the second Y junction-shaped line, and made of an insulator; and a second permanent magnet provided on the second spacer.

2. A nonreciprocal device comprising:

a first carrier plate made of metal;

a first ferrite substrate provided on a front surface of the first carrier plate;

a first Y junction-shaped line provided on the first ferrite substrate, and including three branch lines;

first, second and third lines provided on the first ferrite substrate, and respectively connected to the three branch lines of the first Y junction-shaped line;

fourth and fifth lines provided on the first ferrite substrate;

a first spacer provided on the first Y junction-shaped line, and made of an insulator;

a first permanent magnet provided on the first spacer;

a second carrier plate provided on a back surface of the first carrier plate, and made of metal;

a second ferrite substrate provided on the second carrier plate;

a second Y junction-shaped line provided on the second ferrite substrate, and including three branch lines;

sixth, seventh and eighth lines provided on the second ferrite substrate, and respectively connected to the three branch lines of the second Y junction-shaped line, the sixth line being connected to the first line, the seventh line being connected to the fourth line and the eighth line being connected to fifth line;

a second spacer provided on the second Y junction-shaped line, and made of an insulator; and a second permanent magnet provided on the second spacer.

3. The nonreciprocal device according to claim 2, wherein the sixth line and the first line are connected via a first conductor penetrating the first ferrite substrate, the first carrier plate, the second carrier plate and the second ferrite substrate, the seventh line and the fourth line are connected via a second conductor penetrating the first ferrite substrate, the first carrier plate, the second carrier plate and the second ferrite substrate, and the eighth line and the fifth line are connected via a third conductor penetrating the first ferrite substrate, the first carrier plate, the second carrier plate and the second ferrite substrate.

4. The nonreciprocal device according to claim 1 or claim 2, further comprising a first termination circuit connected to the second line or a second termination circuit connected to the fourth line.

5. A nonreciprocal device comprising:

a first carrier plate made of metal;

a first ferrite substrate provided on a front surface of the first carrier plate;

a first Y junction-shaped line provided on the first ferrite substrate, and including three branch lines;

first, second and third lines provided on the first ferrite substrate, and respectively connected to the three branch lines of the first Y junction-shaped line;

fourth and fifth lines provided on the first ferrite substrate;

a first spacer provided on the first Y junction-shaped line, and made of an insulator;

a first permanent magnet provided on the first spacer;

a second ferrite substrate provided on a back surface of the first carrier plate;

a second Y junction-shaped line provided on the second ferrite substrate, and including three branch lines;

sixth, seventh and eighth lines provided on the second ferrite substrate, and respectively connected to the three branch lines of the second Y junction-shaped line, the sixth line being connected to the first line, the seventh line being connected to the fourth line and the eighth line being connected to fifth line;

a second spacer provided on the second Y junction-shaped line, and made of an insulator; and a second permanent magnet provided on the second spacer.

6. The nonreciprocal device according to claim 5, wherein the sixth line and the first line are connected via a first conductor penetrating the first ferrite substrate, the first carrier plate, and the second ferrite substrate, the seventh line and the fourth line are connected via a second conductor penetrating the first ferrite substrate, the first carrier plate, and the second ferrite substrate, and the eighth line and the fifth line are connected via a third conductor penetrating the first ferrite substrate, the first carrier plate, and the second ferrite substrate.

7. The nonreciprocal device according to any one of claim 1, claim 2 and claim 5, wherein a magnetizing direction of the first permanent magnet is the same as the magnetizing direction of the second permanent magnet.

8. The nonreciprocal device according to any one of claim 1, claim 2 and claim 5, wherein a magnetizing direction of the first permanent magnet is opposite to the magnetizing direction of the second permanent magnet.

9. The nonreciprocal device according to any one of claim 1, claim 2 and claim 5, wherein, the first line, the second line, the third line and the first Y junction-shaped line are formed in one, and the sixth line, the seventh line, the eighth line and the second Y junction-shaped line are formed in one.

* * * * *